US010995381B2

(12) United States Patent
Iung et al.

(10) Patent No.: US 10,995,381 B2
(45) Date of Patent: May 4, 2021

(54) METHOD FOR PRODUCING A TWIP STEEL SHEET HAVING AN AUSTENITIC MICROSTRUCTURE

(71) Applicant: ARCELORMITTAL, Luxembourg (LU)

(72) Inventors: Thierry Iung, Jarny (FR); Gerard Petitgand, Plesnois (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 16/302,974

(22) PCT Filed: May 22, 2017

(86) PCT No.: PCT/IB2017/000606
§ 371 (c)(1),
(2) Date: Nov. 19, 2018

(87) PCT Pub. No.: WO2017/203343
PCT Pub. Date: Nov. 30, 2017

(65) Prior Publication Data

US 2019/0292617 A1 Sep. 26, 2019

(30) Foreign Application Priority Data

May 24, 2016 (WO) ..... PCTIB2016000695

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/16*** | (2006.01) |
| ***C22C 38/20*** | (2006.01) |
| ***C22C 38/24*** | (2006.01) |
| ***C22C 38/38*** | (2006.01) |
| ***C23C 2/02*** | (2006.01) |
| ***C23C 2/06*** | (2006.01) |
| ***C23C 2/12*** | (2006.01) |
| ***C23C 2/40*** | (2006.01) |
| ***C21D 1/26*** | (2006.01) |
| ***C21D 8/02*** | (2006.01) |
| ***C21D 6/00*** | (2006.01) |
| ***C21D 8/04*** | (2006.01) |

(52) U.S. Cl.

CPC ..... *C21D 8/0268* (2013.01); *C21D 6/005* (2013.01); *C21D 8/0436* (2013.01); *C21D 8/0468* (2013.01); *C21D 8/0473* (2013.01); *C21D 8/0484* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/12* (2013.01); *C22C 38/16* (2013.01); *C22C 38/20* (2013.01); *C22C 38/24* (2013.01); *C22C 38/38* (2013.01); *C23C 2/02* (2013.01); *C23C 2/06* (2013.01); *C23C 2/12* (2013.01); *C23C 2/40* (2013.01); *C21D 1/26* (2013.01); *C21D 8/0226* (2013.01); *C21D 8/0236* (2013.01); *C21D 8/0273* (2013.01); *C21D 8/0284* (2013.01); *C21D 2201/02* (2013.01); *C21D 2211/001* (2013.01)

(58) Field of Classification Search
None
See application file for complete search history.

(56) References Cited

U.S. PATENT DOCUMENTS

| | | | |
|---|---|---|---|
| 4,067,754 | A | 1/1978 | Elias et al. |
| 9,738,958 | B2 | 8/2017 | Chin et al. |
| 9,920,445 | B2 | 3/2018 | Campaniello et al. |
| 2003/0145911 | A1 | 8/2003 | Hoffmann et al. |
| 2006/0179638 | A1 | 8/2006 | Engl et al. |
| 2006/0278309 | A1 | 12/2006 | Bouzekri et al. |
| 2008/0083477 | A1 | 4/2008 | Drillet et al. |
| 2009/0010793 | A1 | 1/2009 | Becker et al. |
| 2009/0053556 | A1 | 2/2009 | Sohn et al. |
| 2009/0074605 | A1 | 3/2009 | Kim et al. |
| 2010/0037993 | A1 | 2/2010 | Kim et al. |
| 2011/0017361 | A1 | 1/2011 | Meurer et al. |
| 2013/0081740 | A1 | 4/2013 | Liu |
| 2013/0118647 | A1 | 5/2013 | Berkhout et al. |
| 2013/0177780 | A1 | 7/2013 | Park et al. |
| 2013/0209831 | A1 | 8/2013 | Becker et al. |
| 2013/0209833 | A1 | 8/2013 | Scott et al. |

(Continued)

FOREIGN PATENT DOCUMENTS

| | | | |
|---|---|---|---|
| CN | 105473748 | A | 8/2013 |
| CN | 103820735 | A | 5/2014 |

(Continued)

OTHER PUBLICATIONS

Townsend. "Continuous Hot Dip Coatings." ASM Handbook, vol. 5: Surface Engineering. pp. 339-348. 1994. (Year: 1994).*

(Continued)

*Primary Examiner* — Brian D Walck
(74) *Attorney, Agent, or Firm* — Davidson, Davidson & Kappel, LLC

(57) ABSTRACT

A method for the manufacture of a cold rolled, recovered TWIP steel sheet coated with a metallic coating is provided including the following steps: (A) the feeding of a slab having the following composition: 0.1<C<1.2%, 13.0≤Mn<25.0%, S≤0.030%, P≤0.080%, N≤0.1%, Si≤3.0%, and on a purely optional basis, one or more elements such as Nb≤0.5%, B≤0.005%, Cr≤1.0%, Mo≤0.40%, Ni≤1.0%, Cu≤5.0%, Ti≤0.5%, V≤2.5%, Al≤4.0%, 0.06≤Sn≤0.2%, the remainder of the composition making up of iron and inevitable impurities resulting from elaboration; (B) Reheating such slab and hot rolling it; (C) A coiling step; (D) A first cold-rolling; (E) A recrystallization annealing; (F) A second cold-rolling; and (G) A recovery heat treatment performed by hot-dip coating.

23 Claims, No Drawings

(56) References Cited

U.S. PATENT DOCUMENTS

| | | | |
|---|---|---|---|
| 2014/0209216 | A1 | 7/2014 | Chin et al. |
| 2014/0251505 | A1 | 9/2014 | Blumenau et al. |
| 2015/0152533 | A1 | 6/2015 | Bongards et al. |
| 2015/0211088 | A1 | 7/2015 | Kim et al. |
| 2015/0329951 | A1 | 11/2015 | Jeon et al. |
| 2016/0010173 | A1 | 1/2016 | Scott et al. |
| 2016/0186285 | A1 | 6/2016 | Kim et al. |
| 2016/0319388 | A1 | 11/2016 | Kim et al. |

FOREIGN PATENT DOCUMENTS

| | | | |
|---|---|---|---|
| EP | 1878811 | A1 | 1/2008 |
| EP | 2208803 | A1 | 7/2010 |
| EP | 3088548 | A1 | 11/2016 |
| JP | 2005120399 | A | 5/2005 |
| JP | 2006509912 | A | 3/2006 |
| JP | 2006118000 | A | 5/2006 |
| JP | 2006176843 | A | 7/2006 |
| JP | 2009545676 | A | 12/2009 |
| JP | 2011514436 | A | 5/2011 |
| JP | 2014505168 | A | 2/2014 |
| JP | 2014177662 | A | 9/2014 |
| JP | 2014529684 | A | 11/2014 |
| JP | 2016508183 | A | 3/2016 |
| KR | 20090020278 | A | 2/2009 |
| KR | 20090070502 | A | 7/2009 |
| KR | 20130111214 | A | 10/2013 |
| KR | 20140013333 | A | 2/2014 |
| RU | 2524027 | C1 | 7/2014 |
| WO | 2009084792 | A1 | 7/2009 |
| WO | 2009084793 | A1 | 7/2009 |
| WO | 2015099221 | A1 | 7/2015 |

OTHER PUBLICATIONS

Wolfgang Bleck et al., "New Methods in Steel Design," Metec 2015, Jun. 19, 2015.

* cited by examiner

METHOD FOR PRODUCING A TWIP STEEL SHEET HAVING AN AUSTENITIC MICROSTRUCTURE

FIELD OF THE INVENTION

The present invention relates to a method for producing a TWIP steel sheet having a high strength, an excellent formability and elongation. The invention is particularly well suited for the manufacture of automotive vehicles.

BACKGROUND

With a view of saving the weight of vehicles, it is known to use high strength steels for the manufacture of automobile vehicle. For example for the manufacture of structural parts, mechanical properties of such steels have to be improved. However, even if the strength of the steel is improved, the elongation and therefore the formability of high steels decreased. In order to overcome these problems, twinning induced plasticity steels (TWIP steels) having good formability have appeared. Even if these products show a very good formability, mechanical properties such as Ultimate tensile strength (UTS) and yield stress (YS) may not be high enough to fulfill automotive application.

To improve the strength of these steels while keeping good workability, it is known to induce a high density of twins by cold-rolling followed by a recovery treatment removing dislocations but keeping the twins.

The patent application KR20140013333 discloses a method of manufacturing a high-strength and high-manganese steel sheet with an excellent bendability and elongation, the method comprising the steps of:

- homogenization-processing, by heating to 1050-1300° C., a steel ingot or a continuous casting slab comprising, by weight %, carbon (C): 0.4~0.7%, manganese (Mn): 12~24%, aluminum (Al): 1.1~3.0%, silicon (Si): 0.3% or less, titanium (Ti): 0.005~0.10%, boron (B): 0.0005~0.0050%, phosphorus (P): 0.03% or less, sulfur (S): 0.03% or less, nitrogen(N): 0.04% or less, and the remainder being iron and other unavoidable impurities;
- hot-rolling the homogenization-processed steel ingot or the continuous casting slab at the finish hot rolling temperature of 850-1000° C.;
- coiling the hot-rolled steel sheet at 400-700° C.;
- cold-rolling the wound steel sheet;
- continuously annealing the cold-rolled steel sheet at 400-900° C.;
- optionally, coating step by hot-dip galvanization or electro-galvanization,
- re-rolling the continuously annealed steel sheet at the reduction ratio of 10~50% and
- re-heat processing the rerolled steel sheet at 300-650° C. during 20 seconds to 2 hours.

However, since the coating is deposited before the second cold-rolling, there is a huge risk that the metallic coating is mechanically damaged. Moreover, since the re-heat step is realized after the coating deposition, the interdiffusion of steel and the coating will appear resulting in a significant modification of the coating and therefore of the coating desired properties such that corrosion resistance. Additionally, the re-heat step can be performed in a wide range of temperature and time and none of these elements has been more specified in the specification, even in the examples. Finally, by implementing this method, there is a risk that the productivity decreases and costs increase since a lot of steps are performed to obtain the TWIP steel.

SUMMARY OF THE INVENTION

Thus, an object of the present invention is to provide an improved method for the manufacture of a TWIP steel having a high strength, an excellent formability and elongation. It aims to make available, in particular, an easy to implement method in order to obtain a coated TWIP steel being recovered, such method being costs saving and having an increase in productivity.

This object is achieved by providing a method for the manufacture of a cold rolled, recovered TWIP steel sheet coated with a metallic coating in accordance with an embodiment of the present invention comprising the following steps: A. The feeding of a slab having the following composition: $0.1<C<1.2\%$, $13.0\leq Mn<25.0\%$, $S\leq 0.030\%$, $P\leq 0.080\%$, $N\leq 0.1\%$, $Si\leq 3.0\%$, and on a purely optional basis, one or more elements such as $Nb\leq 0.5\%$, $B\leq 0.005\%$, $Cr\leq 1.0\%$, $Mo\leq 0.40\%$, $Ni\leq 1.0\%$, $Cu\leq 5.0\%$, $Ti\leq 0.5\%$, $V\leq 2.5\%$, $Al\leq 4.0\%$, $0.06\leq Sn\leq 0.2\%$, the remainder of the composition making up of iron and inevitable impurities resulting from elaboration, B. Reheating such slab and hot rolling it, C. A coiling step, D. A first cold-rolling, E. A recrystallization annealing, F. A second cold-rolling and G. A recovery heat treatment performed by hot-dip coating.

Another object is achieved by providing a cold rolled, recovered and coated TWIP steel sheet made in accordance with the above-referenced method.

Other characteristics and advantages of the invention will become apparent from the following detailed description of the invention.

DETAILED DESCRIPTION

In accordance with an embodiment of the present invention, a method for producing a TWIP steel sheet comprising the following steps:

A. The feeding of a slab having the following composition:

$0.1<C<1.2\%$,
$13.0\leq Mn<25.0\%$,
$S\leq 0.030\%$,
$P\leq 0.080\%$,
$N\leq 0.1\%$,
$Si\leq 3.0\%$, and on a purely optional basis, one or more elements such as $Nb\leq 0.5\%$,
$B\leq 0.005\%$,
$Cr\leq 1.0\%$,
$Mo\leq 0.40\%$,
$Ni\leq 1.0\%$,
$Cu\leq 5.0\%$,
$Ti\leq 0.5\%$,
$V\leq 2.5\%$,
$Al\leq 4.0\%$,
$0.06\leq Sn\leq 0.2\%$, the remainder of the composition making up of iron and inevitable impurities resulting from the development, B. Reheating such slab and hot rolling it,
C. A coiling step,
D. A first cold-rolling,
E. A recrystallization annealing,
F. A second cold-rolling and
G. A recovery heat treatment performed by hot-dip coating.

Regarding the chemical composition of the steel, C plays an important role in the formation of the microstructure and the mechanical properties. It increases the stacking fault energy and promotes stability of the austenitic phase. When combined with a Mn content ranging from 13.0 to 25.0% by weight, this stability is achieved for a carbon content of 0.1% or higher. However, for a C content above 1.2%, there is a risk that the ductility decreases. Preferably, the carbon content is between 0.20 and 1.2%, more preferably between 0.5 and 1.0% by weight so as to obtain sufficient strength.

Mn is also an essential element for increasing the strength, for increasing the stacking fault energy and for stabilizing the austenitic phase. If its content is less than 13.0%, there is a risk of martensitic phases forming, which very appreciably reduce the deformability. Moreover, when the manganese content is greater than 25.0%, formation of twins is suppressed, and accordingly, although the strength increases, the ductility at room temperature is degraded. Preferably, the manganese content is between 15.0 and 24.0% so as to optimize the stacking fault energy and to prevent the formation of martensite under the effect of a deformation. Moreover, when the Mn content is greater than 24.0%, the mode of deformation by twinning is less favored than the mode of deformation by perfect dislocation glide.

Al is a particularly effective element for the deoxidation of steel. Like C, it increases the stacking fault energy reducing the risk of forming deformation martensite, thereby improving ductility and delayed fracture resistance. Preferably, the Al content is below or equal to 2%. When the Al content is greater than 4.0%, there is a risk that the formation of twins is suppressed decreasing the ductility.

Silicon is also an effective element for deoxidizing steel and for solid-phase hardening. However, above a content of 3%, it reduces the elongation and tends to form undesirable oxides during certain assembly processes, and it must therefore be kept below this limit. Preferably, the content of silicon is below or equal to 0.6%.

Sulfur and phosphorus are impurities that embrittle the grain boundaries. Their respective contents must not exceed 0.030 and 0.080% so as to maintain sufficient hot ductility.

Some Boron may be added, up to 0.005%, preferably up to 0.001%. This element segregates at the grain boundaries and increases their cohesion to prevent grain boundary crack. Without intending to be bound to a theory, it is believed that this leads to a reduction in the residual stresses after shaping by pressing, and to better resistance to corrosion under stress of the thereby shaped parts.

Nickel may be used optionally for increasing the strength of the steel by solution hardening. However, it is desirable, among others for cost reasons, to limit the nickel content to a maximum content of 1.0% or less and preferably below 0.3%.

Likewise, optionally, an addition of copper with a content not exceeding 5% is one means of hardening the steel by precipitation of copper metal and improved delayed fracture resistance. However, above this content, copper is responsible for the appearance of surface defects in hot-rolled sheet. Preferably, the amount of copper is below 2.0%.

Titanium, Vanadium and Niobium are also elements that may optionally be used to achieve hardening and strengthening by forming precipitates. However, when the Nb or Ti content is greater than 0.50%, there is a risk that an excessive precipitation may cause a reduction in toughness, which has to be avoided. Preferably, the amount of Ti is between 0.040 and 0.50% by weight or between 0.030% and 0.130% by weight. Preferably, the titanium content is between 0.060% and 0.40% and for example between 0.060% and 0.110% by weight. Preferably, the amount of Nb is between 0.070% and 0.50% by weight or 0.040% and 0.220%. Preferably, the niobium content is between 0.090% and 0.40% and advantageously between 0.090% and 0.200% by weight. Preferably, the vanadium amount is between 0.1% and 2.5% and more preferably between 0.1 and 1.0%.

Chromium and Molybdenum may be used as optional element for increasing the strength of the steel by solution hardening. However, since chromium reduces the stacking fault energy, its content must not exceed 1.0% and preferably between 0.070% and 0.6%. Preferably, the chromium content is between 0.20 and 0.5%. Molybdenum may be added in an amount of 0.40% or less, preferably in an amount between 0.14 and 0.40%.

Optionally tin (Sn) is added in an amount between 0.06 and 0.2% by weight. without willing to be bound by any theory, it is believed that since tin is a noble element and does not form a thin oxide film at high temperatures by itself, Sn is precipitated on a surface of a matrix in an annealing prior to a hot dip galvanizing to suppress a pro-oxidant element such as Al, Si, Mn, or the like from being diffused into the surface and forming an oxide, thereby improving galvanizability. However, when the added amount of Sn is less than 0.06%, the effect is not distinct and an increase in the added amount of Sn suppresses the formation of selective oxide, whereas when the added amount of Sn exceeds 0.2%, the added Sn causes hot shortness to deteriorate the hot workability. Therefore, the upper limit of Sn is limited to 0.2% or less.

The steel can also comprise inevitable impurities resulting from the development. For example, inevitable impurities can include without any limitation: O, H, Pb, Co, As, Ge, Ga, Zn and W. For example, the content by weight of each impurity is inferior to 0.1% by weight.

According to the present invention, the method comprises the feeding step A) of a semi product, such as slabs, thin slabs, or strip made of steel having the composition described above, such slab is cast. Preferably, the cast input stock is heated to a temperature above 1000° C., more preferably above 1050° C. and advantageously between 1100 and 1300° C. or used directly at such a temperature after casting, without intermediate cooling.

The hot-rolling is then performed at a temperature preferably above 890° C., or more preferably above 1000° C. to obtain for example a hot-rolled strip usually having a thickness of 2 to 5 mm, or even 1 to 5 mm. To avoid any cracking problem through lack of ductility, the end-of-rolling temperature is preferably above or equal to 850° C.

After the hot-rolling, the strip has to be coiled at a temperature such that no significant precipitation of carbides (essentially cementite $(Fe,Mn)_3C$)) occurs, something which would result in a reduction in certain mechanical properties. The coiling step C) is realized at a temperature below or equal to 580° C., preferably below or equal to 400° C.

A subsequent cold-rolling operation followed by a recrystallization annealing is carried out. These additional steps result in a grain size smaller than that obtained on a hot-rolled strip and therefore results in higher strength properties. Of course, it must be carried out if it is desired to obtain products of smaller thickness, ranging for example from 0.2 mm to a few mm in thickness and preferably from 0.4 to 4 mm.

A hot-rolled product obtained by the process described above is cold-rolled after a possible prior pickling operation has been performed in the usual manner.

The first cold-rolling step D) is performed with a reduction rate between 30 and 70%, preferably between 40 and 60%.

After this rolling step, the grains are highly work-hardened and it is necessary to carry out a recrystallization annealing operation. This treatment has the effect of restoring the ductility and simultaneously reducing the strength. Preferably, this annealing is carried out continuously. Advantageously, the recrystallization annealing E) is realized between 700 and 900° C., preferably between 750 and 850° C., for example during 10 to 500 seconds, preferably between 60 and 180 seconds.

Then, a second cold-rolling step F) is realized with a reduction rate between 1 to 50%, preferably between 10 and 40% and more preferably between 20% and 40%. It allows for the reduction of the steel thickness. Moreover, the steel sheet manufactured according to the aforesaid method, may have increased strength through strain hardening by undergoing a re-rolling step. Additionally, this step induces a high density of twins improving thus the mechanical properties of the steel sheet.

After the second cold-rolling, a recovery step G) is realized in order to additionally secure high elongation and bendability of the re-rolled steel sheet. Recovery is characterized by the removal or rearrangement of dislocations while keeping twins in the steel microstructure, dislocations defects being introduced by plastic deformation of the material.

According to the present invention, the recovery heat treatment is performed by hot-dip coating, i.e. by preparing the surface of the steel sheet for the coating deposition in a continuous annealing followed by the dipping into a molten metallic bath. Thus, the recovery step and the hot-dip coating are realized in the same time allowing costs saving and an increase in productivity in contrary to the patent application KR2014/13333 wherein the hot-dip plating is realized after the recrystallization annealing.

Without willing to be bound by any theory, it seems that the recovery process in the steel microstructure begins during the preparation of steel surface in a continuous annealing and is achieved during the dipping into a molten bath.

The preparation of the steel surface is preferably performed by heating the steel sheet from ambient temperature to the temperature of molten bath, i.e. between 410 to 700° C. In preferred embodiments, the thermal cycle can comprise at least one heating step wherein the steel is heated at a temperature above the temperature of the molten bath. For example, the preparation of the steel sheet surface can be performed at 650° C. during few seconds followed by the dipping into a zinc bath during 5 seconds, the bath temperature being at a temperature of 450° C.

Preferably, the temperature of the molten bath is between 410 and 700° C. depending on the nature of the molten bath.

Advantageously, the steel sheet is dipped into an aluminum-based bath or a zinc-based bath.

In a preferred embodiment, the aluminum-based bath comprises less than 15% Si, less than 5.0% Fe, optionally 0.1 to 8.0% Mg and optionally 0.1 to 30.0% Zn, the remainder being Al. Preferably, the temperature of this bath is between 550 and 700° C., preferably between 600 and 680° C.

In another preferred embodiment, the zinc-based bath comprises 0.01-8.0% Al, optionally 0.2-8.0% Mg, the remainder being Zn. Preferably, the temperature of this bath is between 410 and 550° C., preferably between 410 and 460° C.

The molten bath can also comprise unavoidable impurities and residuals elements from feeding ingots or from the passage of the steel sheet in the molten bath. For example, the optionally impurities are chosen from Sr, Sb, Pb, Ti, Ca, Mn, Sn, La, Ce, Cr, Zr or Bi, the content by weight of each additional element being inferior to 0.3% by weight. The residual elements from feeding ingots or from the passage of the steel sheet in the molten bath can be iron with a content up to 5.0%, preferably 3.0%, by weight.

Advantageously, the recovery step G) is performed during 1 second and 30 minutes, preferably between 30 seconds and 10 minutes. Preferably, the dipping into a molten bath is performed during 1 to 60 seconds, more preferably between 1 and 20 seconds and advantageously, between 1 to 10 seconds.

For example, an annealing step can be performed after the coating deposition in order to obtain a galvannealed steel sheet.

A TWIP steel sheet having an austenitic matrix is thus obtainable from the method according to the invention.

With the method according to the present invention, a TWIP steel sheet having a high strength, an excellent formability and elongation is achieved by inducing a high number of twins thanks to the two cold-rolling steps followed by a recovery step during which dislocations are removed but twins are kept.

EXAMPLE

In this example, TWIP steel sheets having the following weight composition was used:

| Grade | C % | Si % | Mn % | P % | Cr % | % Al | Cu % | % V | % N | S % |
|---|---|---|---|---|---|---|---|---|---|---|
| A | 0.595 | 0.2 | 18.3 | 0.034 | — | 0.785 | 1.68 | 0.18 | 0.01 | ≤0.030 |
| B | 0.894 | 0.513 | 18.64 | 0.02 | 0.109 | 0.003 | 0.156 | 0.002 | 0.0032 | — |
| C | 0.88 | 0.508 | 17.96 | 0.03 | 0.109 | 2.11 | 0.15 | 0.093 | 0.0043 | — |

Firstly, samples were heated and hot-rolled at a temperature of 1200° C. The finishing temperature of hot-rolling was set to 890° C. and the coiling was performed at 400° C. after the hot-rolling. Then, a $1^{st}$ cold-rolling was realized with a cold-rolling reduction ratio of 50%. Thereafter, a recrystallization annealing was performed at 750° C. during 180 seconds. Afterwards, the $2^{nd}$ cold-rolling was realized with a cold-rolling reduction ratio of 30%. Finally, for sample 1, a recovery heat step was performed during 40 seconds in total. The steel sheet was first prepared through heating in a furnace up to 675° C., the time spent between 410 and 675° C. being 37 seconds and then dipped into a molten bath comprising 9% by weight of Silicon, up to 3% of iron, the rest being aluminum during 3 seconds. The molten bath temperature was of 675° C.

For sample 2, a recovery heat step was performed during 65 seconds in total. The steel sheet was first prepared through heating in a furnace up to 650° C., the time spent between 410 and 650° C. being 59 seconds and then dipped into a molten bath comprising 9% by weight of Silicon, up to 3% of iron, the rest being aluminum during 6 seconds. The molten bath temperature was of 650° C.

For sample 3, a recovery heat treatment was performed in a furnace during 60 minutes at a temperature of 450° C. Then, the steel sheet was coated by hot-dip galvanization with a zinc coating, this step comprising a surface preparation step followed by the dipping into a zinc bath during 5 seconds.

For samples 4 and 5, a recovery heat step was performed during 65 seconds in total. The steel sheet was first prepared through heating in a furnace up to 625° C., the time spent between 410 and 650° C. being 15 seconds and then dipped into a zinc bath during 30 seconds. The molten bath temperature was of 460° C. Microstructures of all were then analyzed with a SEM or Scanning Electron Microscopy to confirm that no recrystallization did occur during the recovery step. The mechanical properties of the samples were then determined. Results are in the following Table:

| Samples | Grade | Recovery step performed by hot-dip coating | Recovery time | Recovered samples | UTS (MPa) | Hardness (HV) | TE (%) |
|---|---|---|---|---|---|---|---|
| 1* | A | Yes | 40 s | Yes | 1181 | 378 | — |
| 2* | A | Yes | 65 s | Yes | 1142 | 365 | — |
| 3 | A | No | 60 min | Yes | 1128 | 361 | — |
| 4* | B | Yes | 45 s | Yes | 1463 | 468 | 29 |
| 5* | C | Yes | 45 s | Yes | 1415 | 453 | 23 |

*according to the present invention.

Results show that Samples 1, 2, 4 and 5 were recovered by applying the method according to the present invention. Trial 3 was also recovered by applied a method comprising a recovery step and a coating deposition step, both being performed independently.

The mechanical properties of all Samples are high, in particular for Trials 4 and 5.

The method performed for handling sample 3 took a lot more time than the method according to the invention. Indeed, in industrial scale, in order to perform the method of sample 3, the speed line has to be highly reduced resulting in a significant lost in productivity and in an important costs increase.

What is claimed is:

1. A method for producing a cold rolled, recovered and coated TWIP steel sheet comprising the successive following steps:

A. feeding a slab having the following composition:
- 0.1<C<1.2%,
- 13.0<Mn<25.0%,
- S<0.030%,
- P<0.080%,
- N<0.1%,
- Si<3.0%,
- a remainder of the composition being made of iron and inevitable impurities resulting from processing;

B. reheating and hot rolling the slab to provide a hot rolled slab;

C. coiling the hot rolled slab to provide a coiled slab;

D. first cold-rolling the coiled slab to provide a first cold rolled slab;

E. recrystallization annealing the first cold rolled slab to provide an annealed slab;

F. second cold-rolling the annealed slab to provide a second cold rolled slab; and G. performing a recovery heat treatment on the second cold rolled slab by hot-dip coating.

2. The method according to claim 1, wherein the composition further includes one or more of:
- Nb<0.5%,
- B<0.005%,
- Cr<1.0%,
- Mo<0.40%,
- Ni<1.0%,
- Cu<5.0%,
- Ti<0.5%,
- V<2.5%,
- Al<4.0%, and/or
- 0.06<Sn<0.2%.

3. The method according to claim 1, wherein the reheating is performed at a temperature above 1000° C. and the final rolling temperature is at least 850° C.

4. The method according to claim 1, wherein the coiling is at a temperature below or equal to 580° C.

5. The method according to claim 1, wherein the first cold-rolling step (C) is realized with a reduction rate between 30 and 70%.

6. The method according to claim 1, wherein the recrystallization annealing step (D) is at a temperature between 700 and 900° C.

7. The method according to claim 1, wherein the second cold-rolling step (E) is realized with a reduction rate between 1 to 50%.

8. The method according to claim 1, wherein the hot-dip coating step includes preparing a steel surface of the second cold rolled slab for coating deposition by continuous annealing followed by dipping the second cold rolled slab into a molten metallic bath.

9. The method according to claim 8, wherein during the preparation of the steel surface, the second cold rolled slab is heated from ambient temperature to the temperature of the molten bath.

10. The method according to claim 9, wherein the temperature of the molten bath is between 410 and 700° C.

11. The method according to claim 8, wherein the recovery step (G) includes dipping the second cold rolled slab into an aluminum-based bath or a zinc-based bath.

12. The method according to claim 11, wherein the aluminum-based bath includes less than 15% Si, less than 5.0% Fe, optionally 0.1 to 8.0% Mg and optionally 0.1 to 30.0% Zn, the remainder being Al.

13. The method according to claim 12, wherein a temperature of the molten bath is between 550 and 700° C.

14. The method according to claim 11, wherein the zinc-based bath includes 0.01-8.0% Al, optionally 0.2-8.0% Mg, the remainder being Zn.

15. The method according to claim 14, wherein a temperature of the molten bath is between 410 and 550° C.

16. The method according to claim 1, wherein the recovery step (G) is performed during 1 second to 30 minutes.

17. The method according to claim 16, wherein the recovery step is performed during 30 seconds to 10 minutes.

18. The method according to claim 1, wherein the hot-dip coating includes dipping into a molten bath performed during 1 to 60 seconds.

19. The method according to claim 18, wherein the dipping into a molten bath is performed during 1 and 20 seconds.

20. The method according to claim 19, wherein the dipping into a molten bath is performed during 1 to 10 seconds.

21. The method according to claim 1, further comprising pickling the hot rolled slab before the first cold rolling.

22. The method according to claim 1, wherein the annealed slab is uncoated when the second cold rolling is performed.

23. The method according to claim 1, wherein the second cold rolling reduces the annealed slab at a reduction ratio of 30%.

* * * * *